United States Patent [19]

Courrege

[11] Patent Number: 4,846,716

[45] Date of Patent: Jul. 11, 1989

[54] IGNITION DEVICE FOR A HIGH SPEED BURNER OF THE COLD NOZZLE TYPE AND A BURNER USING SAID DEVICE

[75] Inventor: Claude Courrege, La Haillan, France

[73] Assignee: Stepack, Le Haillan, France

[21] Appl. No.: 119,514

[22] Filed: Nov. 12, 1987

[30] Foreign Application Priority Data

Nov. 12, 1986 [FR] France ..... 86 15969

[51] Int. Cl.[4] ..... F23D 11/42

[52] U.S. Cl. ..... 431/263; 431/264; 431/266; 431/329

[58] Field of Search ..... 431/158, 255, 263, 264, 431/266

[56] References Cited

U.S. PATENT DOCUMENTS

| | | | |
|---|---|---|---|
| 554,253 | 2/1896 | Finlay | 431/346 |
| 1,354,295 | 9/1920 | Hamilton | 431/346 |
| 2,105,344 | 1/1938 | Campbell | 431/263 |
| 2,985,233 | 5/1961 | Stellmach | 431/355 |
| 3,035,632 | 5/1962 | Ericsson | 431/346 |
| 4,082,497 | 4/1978 | Crawford et al. | 431/158 |
| 4,251,205 | 2/1981 | Roeder et al. | 431/263 |
| 4,631,023 | 12/1986 | Courrege | 431/354 |

*Primary Examiner*—Martin P. Schwadron
*Assistant Examiner*—Allen J. Flanigan
*Attorney, Agent, or Firm*—William A. Drucker

[57] ABSTRACT

An ignition device for a high speed burner of the cold nozzle type including a conventional type injector, an adaptation chamber into which the injector emerges and ending in an orifice with an outwardly curved grid and an ignition chamber, an ignition cavity is also provided external to the ignition chamber and communicating therewith through an orifice of reduced passage section provided in the wall of the ignition chamber substantially in line with the front region of the grid.

5 Claims, 2 Drawing Sheets

IGNITION DEVICE FOR A HIGH SPEED BURNER OF THE COLD NOZZLE TYPE AND A BURNER USING SAID DEVICE

BACKGROUND OF THE INVENTION

1. Field of the Invention

The present invention relates to an ignition device for a high speed burner of the cold nozzle type.

It relates more particularly, but not exclusively to a burner of this kind including:

a conventional type injector formed by the combination of an injection nozzle for a pressurized fuel gas, for example propane, a mixer duct into which said nozzle feeds and orifices opening to the free air, through which the air is sucked into the duct by venturi effect, is mixed with the fuel gas and is accelerated in the duct so as to form a high speed flow of a gaseous mixture;

an equation chamber, into which the injector opens, this adaptation chamber possibly having a bell mouth shape ending in an orifice having an outwardly curved grid;

an ignition chamber in which combustion of the gaseous mixture is initiated, which leaves at high speed through the perforations of the grid, this ignition chamber being formed by a tubular element extending the adaptation chamber; and deflection means equipping the external opening of the ignition chamber and oriented so as to converge towards each other from opposite zones of said opening.

2. Description of the Prior Art

In this type of burner the beginning of the flame inside the ignition chamber is generated by the gaseous mixture jets produced by the central perforations of the grid which undergo an expansion phenomenon and slow down. Inside the ignition chamber, the nascent flame of a substantially parabolic shape occupies only a fraction of this chamber. It leaves the burner at high speed while passing between the deflectors to be then propagated in the free air while generating, beyond its leading front, a flow of hot air propagating axially with respect to the burner.

The effect of the cold nozzle is then due to the interaction of the lateral parts of the grid, of the walls of the ignition chamber and, to a lesser extent, of the deflectors.

In fact, the lateral parts of the grid form with said walls wedge shape spaces which constitute dead spaces in which the flame cannot propagate. These dead spaces are traversed by the gaseous mixture jets coming from the perforations of the lateral parts of the grid which then run into each other and flow as a gas flow over the walls of the ignition chamber over the deflectors. This gas flow, not ignited, then provides heat insulation and continuous cooling of the walls which cannot therefore overheat. This phenomenon further extends to the deflectors which are then not licked by the flame and which are then not subject to any overheating.

For igniting the flame, an ignition plug has also been proposed mounted in a tubular housing opening into the ignition chamber through an orifice provided at a position on the wall of said chamber situated in line with the lateral zone of the grid.

However, in use it has proved that this solution has serious drawbacks. In fact, the tubular housing for the gas flow emitted by the perforations of the grid. Thus, a permanent self sustained combustion of the gas flow may be formed at this level of the cavity, causing overheating of the wall of the ignition chamber, which is contrary to the desired aim.

SUMMARY OF THE INVENTION

The purpose of the invention is then in particular to overcome these drawbacks. It provides an ignition device including a lighting chamber external to the ignition chamber and communicating therewith through an orifice of reduced passage section provided in the wall of the ignition chamber substantially in line with the front region of the grid, the section of this orifice being provided sufficiently small so that disturbances of the gas flow at the level of this orifice cannot generate a seat of self sustained parasite combustion likely to overheat the wall of the ignition chamber.

Furthermore, the dimensions of this orifice as well as those of the ignition chamber are provided so that combustion of the gas mixture cannot develop permanently inside the lighting chamber.

Advantageously, the lighting chamber may be formed by a blind cylindrical bore formed in an external metal part fixed to the wall of the ignition chamber. This bore, disposed parallel to the longitudinal axis of the burner is then closed, on the side opposite the bottom, by an electrode holder made from an electrically insulating material, which defines an lighting chamber in which the electrode extends axially. This lighting chamber is further connected to the ignition chamber through a transverse bore communicating with an orifice in the wall of said chamber.

BRIEF DESCRIPTION OF THE DRAWINGS

One embodiment of the invention will be described hereafter by way of non limitative example, with reference to the accompanying drawings in which.

DESCRIPTION OF THE PREFERRED EMBODIMENT

Figure 1:
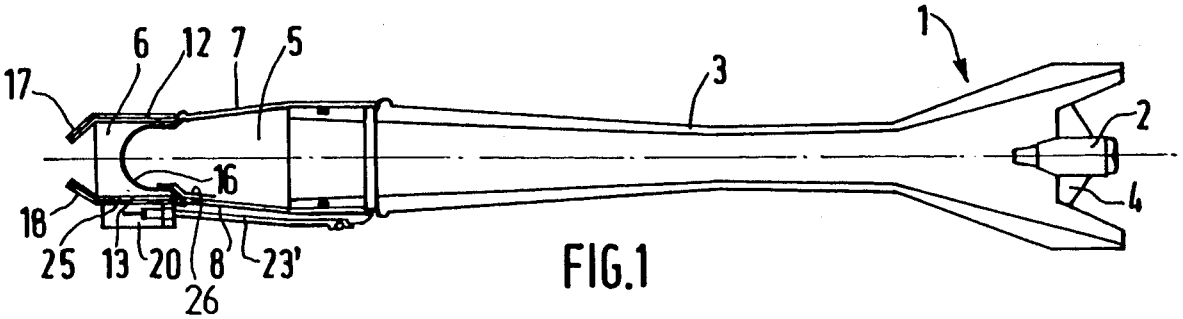
FIG. 1 is a schematical axial sectional view of a high speed burner of the cold nozzle type in accordance with the invention.
Figure 2:
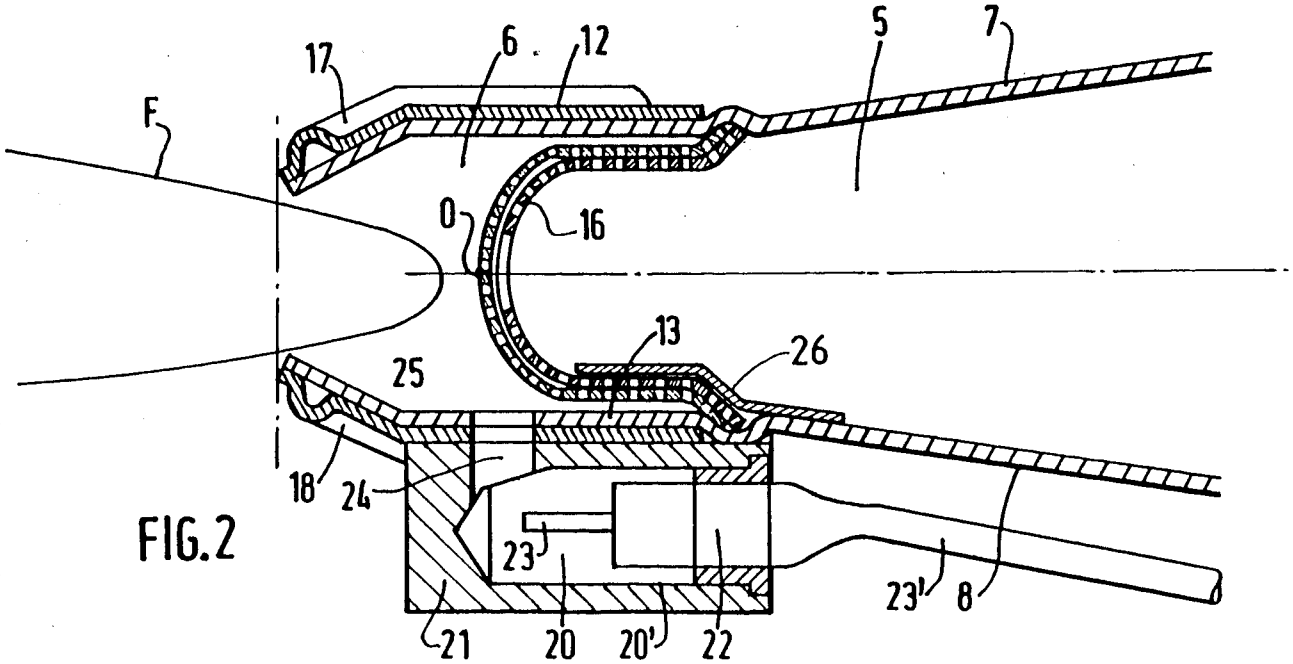
FIG. 2 is a view on a larger scale of the head of the burner shown in FIG. 1.
Figure 3:
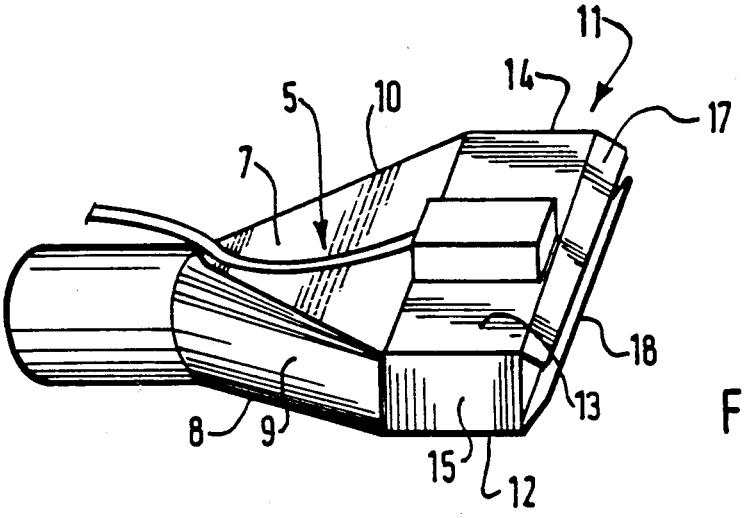
FIG. 3 is a schematical perspective view of the burner head shown in FIG. 2.
Figure 4:
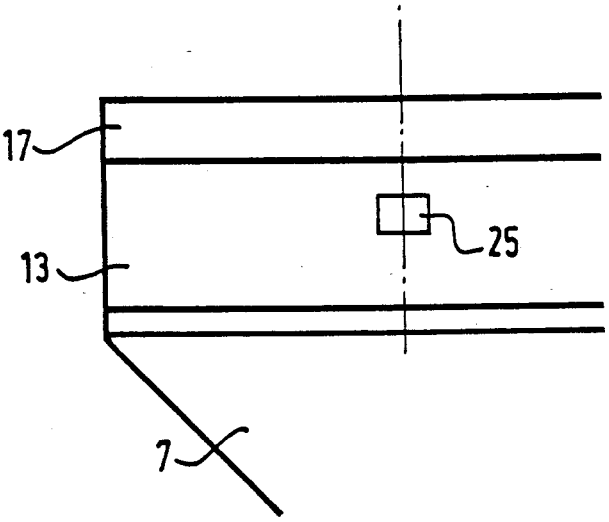
FIG.4 is a partial schematical view of the inner wall of the ignition chamber, with the ignition orifice.

Such as shown in FIG. 1, the burner is formed more particularly:

of a conventional type injector 1 including:

a nozzle 2 connected to an ignitable gas source (for example a propane cylinder) at a pressure of about 3 to 4 bars, a pipe 3 into which said pressurized gas is injected, and at least one air passage opening 4 situated at the level of the junction between said nozzle 2 and said pipe 3, this assembly forms a jet pump which drives the air coming from opening 4 and generates at the input of pipe 3 a high speed gas mixture flow, of the order of 12660 meters minute;

an adaptation chamber 5 into which pipe 3 opens, this chamber 5 having a tubular bell shape which extends the outlet section of pipe 3 and includes two very slightly convergent walls 7, 8 of increasing width and two divergent side walls 9, 10 (FIG. 3) of a slightly decreasing width, so that the cross section of this adaptation chamber 5 increases from its connection with pipe 3;

an ignition chamber 6 formed by a tubular portion 11 of parallelepipedic shape which includes two parallel relatively wide faces 12, 13 which project in the extension of the two convergent walls 7, 8 of the adaptation chamber 5 and two parallel lateral faces 14, 15, of small width, which project in the extension of the two divergent walls 9, 10 of said chamber 5;

a double diffusion grid 16 formed of two perforated metal sheet parts of a semicylindrical shape, disposed perpendicularly to the axis of pipe 3 and parallel to faces 12 and 13, this double grid which is fixed to the burner by its two longitudinal edges at the level of the connection zone between chambers 5 and 6 forms a convex dividing wall whose concavity is oriented towards the inside of the adpatation chamber 5 and whose central portion which only has a thickness of one grid is situated in the vicinity of the external orifice of the ignition chamber 6;

two deflectors 17, 18 respectively extending the two faces 12, 13 and forming therewith an angle of about 45°;

a tongue 26 causing slowing down of the gas flow in line with opening 24 of the electrode holder 22.

In the burner which has just been described, the fuel mixture injected into the adaptation chamber 5 forms, through the perforations of grid 16, a succession of jets flowing at high speed (of the order of 2400 m/min).

In the central part 0 of grid 16, these jets are oriented axially (in the axis of the pipe); whereas in the lateral parts they are substantially radial and strike walls 12, 13 and the deflector 17, 18.

It can be seen that the low speed of the gas mixture formed by the jets produced in the central region 0 of grid 16 undergoes a deceleration (the speed dropping rapidly to 1600 m/min). This is partly due to the fact that on leaving the central perforations of grid 16 there occurs an expansion of the fuel mixture, this expansion being promoted by the distribution of the gas flow into jets. This reduction of the flow speed makes it possible for combustion to begin at a slight distance from grid 16.

From the ignition point, flame F propagates towards the outside of the ignition chamber in a shape which is substantially parabolic in axial cross section, without licking the walls of chamber 6 and deflectors 17, 18.

In fact, as mentioned before, the lateral parts of the grid form with walls 12, 13 width shaped spaces which form dead spaces in which the flame cannot propagate.

The gas mixture jets coming from the perforations of the lateral parts of the grid pass through these dead spaces and then run into each other and flow as a gas flow over walls 12, 13 of the ignition chamber 6 and over the deflector 17, 18.

The walls 12, 13 of the ignition chamber 6 and deflectors 17 18 which are therefore not licked by the flame F and are ventilated by the fuel mixture flow do not then overheat and are on the contrary constantly cooled.

This explains the reason why the burner undergoes no appreciable rise in temperature (cold nozzle burner).

In this example, the ignition device includes an lighting chamber 20 consisting of a blind bore 20' formed in a parallelepipedic shaped metal part 21, fixed to the wall 13 of the ignition chamber 6.

In this bore is engaged a cylindrical electrode holder 22 made from an electrically insulating material from which there extends coaxially an ignition electrode 23 which penetrates into the lighting chamber. This electrode 23 is further connected to an electric generator, for example a piezoelectric generator, by means of an electric cable 23'.

The lighting chamber 20 communicates with the ignition chamber 6 through a transverse bore 24 formed in part 21, which corresponds with a bore 25 formed in the wall 13 of the ignition chamber 6.

Bores 24 and 25 are dimensioned so as to form an access passage for the gas mixture into the lighting chamber 20.

Thus, the emission of a spark by electrode 23 causes abrupt combustion of the gas mixture in the lighting chamber 20. The combustion gases are then ejected through the passage formed by bore 24, 25 and consequently ignite the gas mixture flow leaving the central perforations of grid 16.

This passage 24, 25 must necessarily have a reduced section so as to avoid any possibility of disturbances of the gas flow in its vicinity which would lead to the formation of permanent combustion.

Thus, in this example, a diameter has been provided for bore 24 of the order of 4 mm, for a diameter of the ignition chamber 20 of 8 mm. It should however be noted that diameters between 3 and 8 mm could be suitable as required.

Similarly, it is possible to provide in wall 13 bores of a square or rectangular section with sides having lengths in the range of dimensions provided for the above indicated diameters.

With the above indicated arrangements it has proved that the ignition device causes no self sustained parasite combustion likely to generate overheating of the burner.

What is claimed is:

1. An ignition device for high speed burner of the cold nozzle type, this burner including:

a conventional type injector comprising a nozzle for a pressurized fuel gas and a pipe into which said nozzle feeds, said pipe being provided with at least one air passage opening through which the air is sucked into the pipe by venturi effect, thereafter said air being mixed with the fuel gas and accelerated in the pipe so as to form a high speed flow of a gaseous mixture;

an adaptation chamber, into which the injector opens, and ending in an orifice having an outwardly curved grid;

an ignition chamber in which combustion of the gaseous mixture is initiated, which leaves at high speed through the perforations of the grid, this ignition chamber being formed by a tubular portion extending said adatation chamber and being provided with an external opening; and which device further includes means forming on a wall of the ignition chamber an external lighting chamber located outside the ignition chamber and communicating therewith through an orifice of reduced passage section provided in the said wall substantially in line with the front region of the grid, the section of said orifice being provided sufficiently small so that disturbances of the gas flow at the level of said orifice cannot generate a seat of self sustained parasite combustion like to overheat the wall of the ignition chamber and the dimenisons of said orifice as well as those of said lighting chamber being provided so that combustion of the gas mixture cannot develop permanently inside the lighting chamber.

2. The ignition device as claimed in claim 1, wherein said burner further includes deflection means equipping the extenral opening of the igniton chamber and oriented so as to converge towards each other from two opposite zones of said opening.

3. The device as claimed in claim 1, wherein said lighting chamber is formed by a blind cylindrical bore formed in an external metal part fixed to the wall of said ignition chamber and this bore, disposed parallel to the longitudinal axis of the burner, is closed, on the side opposite the bottom, by an electrode holder made from an electrically insulating material, which defines a cavity in which the electrode extends axially.

4. The device as claimed in claim 3, wherein said cavity is connected to the ignition chamber through a transverse bore commmunicating with a passage orifice in the wall of said ignition chamber.

5. The device as claimed in claim 4, wherein said passage orifice has at least partially a square or rectangular section.

* * * * *